US006354919B2

(12) United States Patent
Chopra

(10) Patent No.: US 6,354,919 B2
(45) Date of Patent: Mar. 12, 2002

(54) POLISHING PADS AND PLANARIZING MACHINES FOR MECHANICAL AND/OR CHEMICAL-MECHANICAL PLANARIZATION OF MICROELECTRONIC SUBSTRATE ASSEMBLIES

(75) Inventor: Dinesh Chopra, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/851,613

(22) Filed: May 8, 2001

Related U.S. Application Data

(62) Division of application No. 09/387,307, filed on Aug. 31, 1999.

(51) Int. Cl.[7] ..... B24B 1/00
(52) U.S. Cl. ..... 451/57; 451/285; 451/287
(58) Field of Search ..... 451/41, 285, 287, 451/57, 288, 289, 290, 388

(56) References Cited

U.S. PATENT DOCUMENTS

| | | | | | |
|---|---|---|---|---|---|
| 3,801,293 | A | * | 4/1974 | Kiser | 451/296 X |
| 5,234,867 | A | | 8/1993 | Schultz et al. | 437/225 |
| 5,593,344 | A | * | 1/1997 | Weldon et al. | 451/296 |
| 5,664,989 | A | | 9/1997 | Nakata et al. | 451/41 |
| 5,810,964 | A | | 9/1998 | Shiraishi | 156/345 |
| 5,997,384 | A | * | 12/1999 | Blalock | 451/41 |
| 6,039,633 | A | * | 3/2000 | Chopra | 451/41 |
| 6,176,763 | B1 | * | 1/2001 | Kramer et al. | 451/41 |
| 6,180,020 | B1 | * | 1/2001 | Moriyama et al. | 216/88 |

OTHER PUBLICATIONS

Kosmulski, Michal, "About zeta potential," http://hermes.umcs.lublin.pl/users/komulski/michal/zetapo.htm; 3 pages, last accessed Jun. 7, 2000.

"About Brookhaven Instruments Corporation," http://www.bic.com/aboutbic.htm; 2 pages, last accessed Jun.7, 2000.

"Zeta potential and Stability," http://www.bic.com/ztheory1.htm; 3 pages, last accessed Jun. 7, 2000.

"When Zeta Potential is Important," http://www.bic.com./morezeta.htm; 1 page, last accessed Jun. 7, 2000.

"Characterising and Controlling High Solid Suspensions Using Zeta Potential," http:///www.ceram.co.uk/ptp/1996 projects/jmichaelp.htm; 2 pages, lasct accessed Jun. 7, 2000.

(List continued on next page.)

*Primary Examiner*—Joseph J. Hail, III
*Assistant Examiner*—Anthony Ojini
(74) *Attorney, Agent, or Firm*—Dorsey & Whitney LLP

(57) ABSTRACT

Polishing pads, planarizing machines and methods for mechanical and/or chemical-mechanical planarization of semiconductor wafers, field emission displays or other microelectronic substrate assemblies. One planarizing machine of the invention is a web-format machine having a planarizing table to support a portion of the polishing pad in a planarizing zone, at least one roller to hold another portion of the polishing pad, and a carrier assembly for handling a microelectronic substrate assembly. A web-format polishing pad used with this machine can include a body having a planarizing medium, an elongated first side edge, and an elongated second side edge opposite the first side edge. The body has a length sufficient to extend across the planarizing zone and wrap around the roller. The planarizing medium can have an elongated interior region extending lengthwise along the body, an elongated first side region extending lengthwise along the first side edge, and an elongated second side region extending lengthwise along the second side edge. The polishing pad can further include a first planarizing structure in the interior region that has a first planarizing aggressiveness, and a second planarizing structure in each of the side regions having a second planarizing aggressiveness. The second planarizing aggressiveness is less than the first planarizing aggressiveness.

16 Claims, 6 Drawing Sheets

OTHER PUBLICATIONS

"An introduction to zeta potential," http://reliant.pharm.nottingham.ac.uk/zeta.html; 1 page, last accessed Jun. 7, 2000.
"Why are interfaces charged?" http://reliant.pharm.nottingham.ac.uk/charge.html; 3 pages, last accessed Jun. 7, 2000.
"Zeta potential and electroytes," http://reliant.pharm.nottingham.ac.uk/elect.html; 3 pages, last accessed Jun.7, 2000.
"Measurement of Zeta Potential," http://reliant.pharm.nottingham.ac.uk/meas.html; 3 pages, last accessed Jun 7, 2000.
"Planning your zeta potential experiment," http://reliant.pharm.nottingham.ac.uk/plan.html; 2 pages, last accessed Jun. 7, 2000.
"Operating prolcedure for the Zetasier," http://reliant.pharm.nottingham.ac.uk/use.html; 4 pages, last accessed Jun. 7, 2000.

* cited by examiner

POLISHING PADS AND PLANARIZING MACHINES FOR MECHANICAL AND/OR CHEMICAL-MECHANICAL PLANARIZATION OF MICROELECTRONIC SUBSTRATE ASSEMBLIES

CROSS-REFERENCE TO RELATED APPLICATION

This application is a divisional of pending U.S. patent application Ser. No. 09/387,307, filed Aug. 31, 1999.

TECHNICAL FIELD

The present invention relates to methods and apparatuses for planarizing microelectronic substrate assemblies and, more particularly, to polishing pads and planarizing machines for mechanical and/or chemical-mechanical planarization.

BACKGROUND OF THE INVENTION

Mechanical and chemical-mechanical planarizing processes (collectively "CMP") are used in the manufacturing of electronic devices for forming a flat surface on semiconductor wafers, field emission displays, and many other microelectronic substrate assemblies. CMP processes generally remove material from a substrate assembly to create a highly planar surface at a precise elevation in the layers of material on the substrate assembly.

FIG. 1 schematically illustrates a rotary CMP machine 10 for planarizing a microelectronic substrate assembly 12. The rotary machine 10 has a platen 20, a wafer carrier assembly 30 above the platen 20, and a polishing pad 40 between the platen 20 and the carrier assembly 30. The carrier assembly 30 generally includes a head 32 to pick up, hold and release the substrate assembly 12 at the appropriate stages of the planarizing process. The carrier assembly 30 can also include a backing pad 34 to support the back side of the substrate assembly 12. The head 32 may be a weighted, free-floating unit, or the carrier assembly 30 can further include an actuator 36 attached to the head 32 to impart axial and/or rotational motion (indicated by arrows C and D, respectively).

The polishing pad 40 can be a non-abrasive polymeric pad (e.g., polyurethane), or it may be a fixed-abrasive polishing pad in which abrasive particles are fixedly dispersed in a resin or another type of suspension medium. A planarizing fluid 44 covers the polishing pad 40 during planarization of the substrate assembly 12. The planarizing fluid 44 may be a conventional CMP slurry with abrasive particles that etch and/or oxidize the surface of the substrate assembly 12, or the planarizing fluid 44 may be a "clean" non-abrasive planarizing solution without abrasive particles. In most CMP applications, abrasive slurries with abrasive particles are used on non-abrasive polishing pads, and non-abrasive cleaning solutions without abrasive particles are used on fixed-abrasive polishing pads.

To planarize the substrate assembly 12 with the CMP machine 10, the carrier assembly 30 presses the substrate assembly 12 face-downward against a planarizing surface 42 of the polishing pad 40. At least one of the platen 20 or the head 32 moves relative to the other to move the substrate assembly 12 across the planarizing surface 42 in the presence of the planarizing solution 44. As the face of the substrate assembly 12 moves across the planarizing surface 42, the polishing pad 40 and/or the planarizing solution 44 continually remove material from the face of the substrate assembly 12.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns to such small tolerances, however, is difficult when the planarized surfaces of substrate assemblies are not uniformly planar. Thus, to be effective, CMP processes should create highly uniform, planar surfaces on substrate assemblies.

One manufacturing concern of CMP processing is that the surface of the substrate assembly may not be uniformly planar because the rate at which material is removed from the substrate assembly (the "polishing rate") may vary from one area to another. The polishing rate depends, in part, on the relative linear velocity between the surface of the wafer and the portion of the planarizing surface contacting the wafer. The linear velocity of the planarizing surface of a circular, rotating polishing pad varies across the planarizing surface of the pad in proportion to the radial distance from the center of the pad. Similarly, when the head rotates the wafer, the linear velocity also varies across the front face of the wafer in proportion to the radial distance from the center of the wafer. The variation of linear velocities across the face of the wafer and the planarizing surface of the polishing pad creates a relative velocity gradient in between the wafer and the polishing pad. In general, the relative velocity gradient between the wafer and the pad causes a higher polishing rate at the perimeter of the wafer than at the center of the wafer. Such a variance in the polishing rate produces a center-to-edge profile in which more material is removed from the perimeter of the wafer than the center.

Several devices and concepts have been developed to reduce the center-to-edge planarizing profile across wafers. U.S. Pat. No. 5,020,283 issued to Tuttle, which is herein incorporated by reference, discloses a non-abrasive polishing pad with voids in the surface of the pad. The area of the planarizing surface occupied by the voids increases with increasing radial distance to reduce the contact area between the wafer and the planarizing surface of the polishing pad towards the perimeter of the pad. Thus, at the periphery of the pad where the linear velocity of the pad is high, the voids are intended to reduce the polishing rate of the wafer compared to a planarizing surface without such voids.

U.S. patent application Ser. No. 08/834,524 filed by Hudson, which is herein incorporated by reference, discloses an abrasive polishing pad designed to reduce the center-to-edge planarizing profile across or substrate assembly. In one embodiment disclosed in Hudson, the abrasive polishing pad has a planarizing surface with a first planarizing region and a second planarizing region. The first planarizing region has a first abrasiveness and the second planarizing region has a second abrasiveness different than the first abrasiveness of the first region. Hudson discloses that the abrasiveness of the first and second regions can be controlled by using either different types, sizes or densities of abrasive particles fixedly suspended in a suspension medium. Additionally, this application discloses varying the contact/non-contact bearing surfaces on the pad between the first and second regions. The different abrasivity of the first and second planarizing regions are intended to compensate for variations in the relative velocity across the face of the wafer.

Another polishing pad developed to reduce the center-to-edge planarizing profile across a wafer is disclosed in U.S. Pat. No. 5,435,772 issued to Yu, which is also herein incorporated by reference. Yu discloses a circular polishing pad including a first region closer to the edge of the polishing pad and a second region adjacent to the first region toward the center of the polishing pad. The polishing pad disclosed in Yu is configured so that the second region is thicker or less compressible than the first region. Yu states that having a thicker or less compressible portion at the center of the pad and a thinner portion at the perimeter of the pad produces more uniform polishing results.

SUMMARY OF THE INVENTION

The present invention is directed toward polishing pads and planarizing machines in mechanical and/or chemical-mechanical planarization of semiconductor wafers, field emission displays or other microelectronic substrate assemblies. One polishing pad of the invention is a web-format pad for use with a web-format planarizing machine. The web-format polishing pad can include a body having a planarizing medium, an elongated first side edge, an elongated second side edge opposite the first side edge, and a length sufficient to extend across a planarizing zone. The planarizing medium can have an elongated interior region extending lengthwise along the body, an elongated first exterior side region extending lengthwise along the first side edge, and an elongated second exterior side region extending lengthwise along the second side edge. The polishing pad can further include a first planarizing structure having a first planarizing aggressiveness in the interior region and a second planarizing structure having a second planarizing aggressiveness in each of the side regions. The first planarizing aggressiveness is greater than the second planarizing aggressiveness. The first and second planarizing structures generally have characteristics that cause the interior region to remove material from a point on the substrate assembly faster than either of the side regions. The planarizing structures, for example, can be components or elements that affect the hardness of the material of the planarizing medium, the abrasiveness or density of abrasive particles attached to the planarizing medium, the height of raised features on the planarizing medium, or the pattern of grooves in the planarizing medium. The interior and side regions are generally configured so that at least a portion of the perimeter region of the substrate assembly contacts the less aggressive side regions for more time than the central region of the substrate assembly to reduce the center-to-edge polishing gradient across the substrate assembly.

The first and second planarizing structures can also be a combination of two or more planarizing components. For example, the planarizing structures can be any combination of the hardness of the planarizing medium, the abrasiveness or density of abrasive particles attached to the planarizing medium, the height of raised features on the planarizing medium, and/or the pattern of grooves in the planarizing medium.

DETAILED DESCRIPTION OF THE INVENTION

The present invention relates to polishing pads and planarizing machines for mechanical and/or chemical-mechanical planarizing ("CMP") of microelectronic substrates. Several embodiments of the invention are described below and shown in FIGS. 2–10 to provide a thorough understanding of how the polishing pads are made and used. The disclosed embodiments of the invention include the best known embodiments for CMP processing of semiconductor wafers. It will be appreciated that additional embodiments of the invention may not include all of the details and features of the embodiments set forth in the following detailed description, and that still other embodiments may include additional features. Therefore, several embodiments of polishing pads and planarizing machines that are not expressly disclosed in the following detailed description may be covered by the appended claims.

Figure 2:
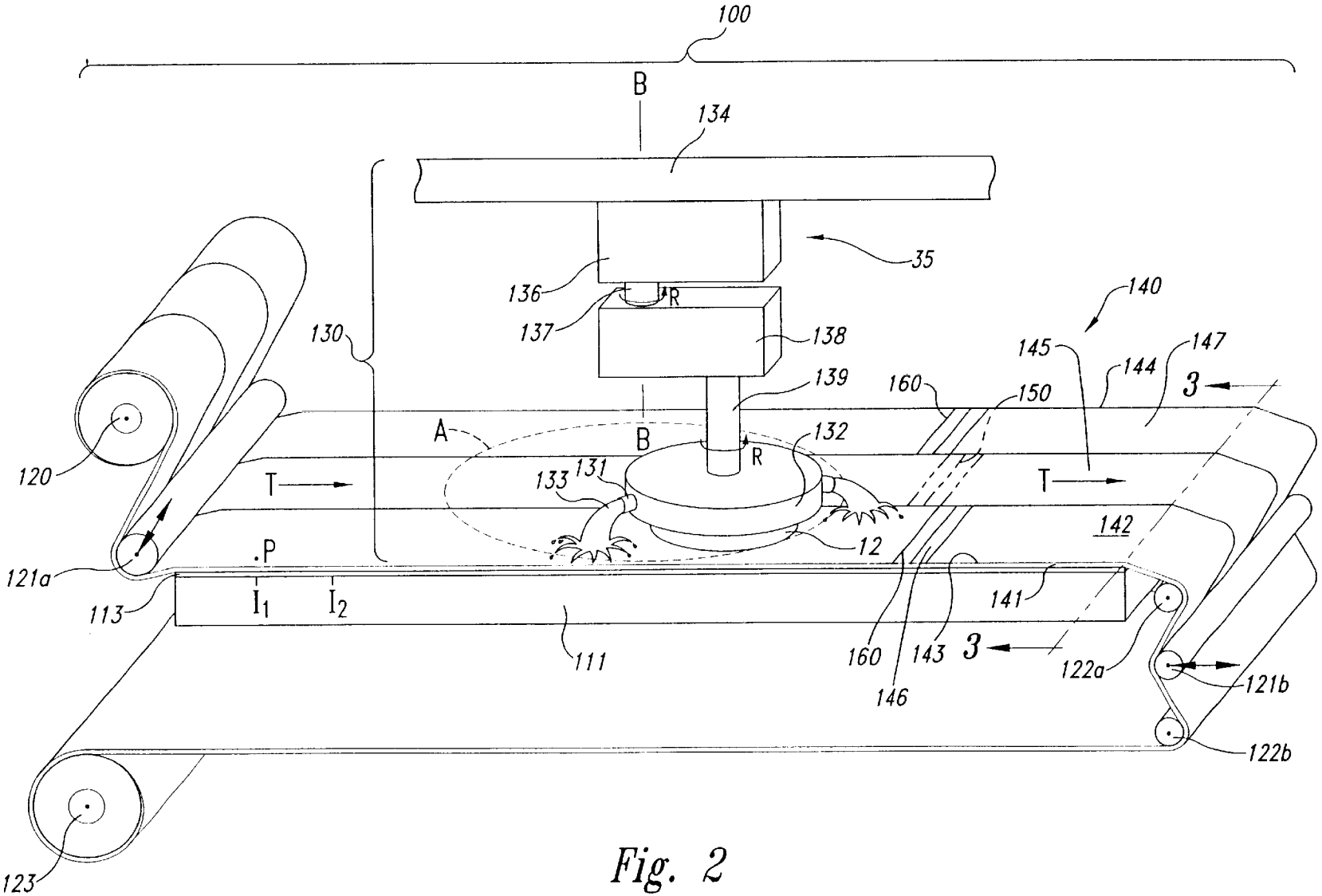
FIG. 2 is a schematic isometric view of a web-format planarizing machine including a polishing pad in accordance with an embodiment of the invention.

FIG. 2 is a schematic isometric view of a web-format planarizing machine 100 including a web-format polishing pad 140 in accordance with one embodiment of the invention. The planarizing machine 100 has a table 111 with a rigid panel or plate to provide a flat, solid support surface 113 for supporting a portion of the polishing pad 140 in a planarizing zone "A." The planarizing machine 100 also has a pad advancing mechanism including a plurality of rollers to guide, position, and hold the pad 140 over the support surface 113. The pad advancing mechanism generally includes a supply roller 120, first and second idler rollers 121*a* and 121*b*, first and second guide rollers 122*a* and 122*b*, and a take-up roller 123. A motor (not shown) drives the take-up roller 123 to advance the pad 140 across the support surface 113 along a travel axis T—T. The motor can also drive the supply roller 120. The first idler roller 121*a* and the first guide roller 122*a* press an operative portion of the pad 140 against the support surface 113 to hold the pad 140 stationary during operation.

The planarizing machine 100 also has a carrier assembly 130 to translate a substrate assembly 12 across the pad 140. In one embodiment, the carrier assembly 130 has a head 132 to pick up, hold, and release the substrate assembly 12 at appropriate stages of the planarizing process. The carrier assembly 130 has a support gantry 134 and a drive assembly 135 that can move along the gantry 134. The drive assembly 135, more particularly, can have an actuator 136, a drive shaft 137 coupled to the actuator 136, and an arm 138 projecting from the drive shaft 137. The arm 138 carries the head 132 via another shaft 139. In operation, the actuator 136 orbits the head 132 about an axis B—B to move the substrate assembly 12 across the polishing pad 140. As the head 132 orbits about the B—B axis, a planarizing fluid 133 flows from a plurality of nozzles 131 projecting from the head 132.

The planarizing machine 100 moves the polishing pad 140 across the support surface 113 along the pad travel path T—T either during or between planarizing cycles to change the particular portion of the polishing pad 140 in the planarizing zone A. For example, the motor can drive the supply roller 120 and the take-up roller 123 to drive the polishing pad 140 between planarizing cycles such that a point P moves incrementally across the support surface 113 to intermediate locations $I_1$, $I_2$, etc. Alternatively, the supply roller 120 and the take-up roller 123 can drive the polishing pad 140 between planarizing cycles such that the point P moves all the way across the support surface 113 to completely remove a used portion of the pad 140 from the planarizing zone A. The rollers 120 and 123 may also continuously drive the polishing pad 140 at a slow rate during the planarizing cycle such that the point P continually moves across the support surface 113. The polishing pad 140 should accordingly be free to move axially over the length of the support surface 113 along the pad travel path T—T. With this understanding of the planarizing machine 100, the polishing pad 140 will now be described with reference to web-format applications.

The polishing pad 140 is a web-format pad that includes a body 141 having a planarizing medium 142, an elongated first side edge 143, and an elongated second side edge 144 opposite the first side edge 143. The pad 140 has a length sufficient to extend across the planarizing zone A and wrap around the supply roller 120 and/or the take-up roller 123. The planarizing medium 142 includes an elongated interior region 145 extending lengthwise along the body 141, an elongated first side region 146 extending lengthwise along the first side edge 143, and an elongated second side region 147 extending lengthwise along the second side edge 144. The width of the interior region 145 and the side regions 146/147 can be approximately equal to one another (shown in FIG. 2), or they can be different from one another to provide the desired proportion of surface area between the interior and side regions. The width of the interior region 145 can be approximately 10 to 18 inches, and the width of each side region 146/147 can be approximately 2.5 inches. The width of the interior region 145 can also be approximately 50–95% of the total pad width, and the width of each side region 146/147 can be approximately 2.5–25% of the total pad width.

In a particular embodiment, the width of the interior region is 14 inches or approximately 70–75% of the total pad width, and the width of each side region 146/147 is 2.5 inches or approximately 12.5–15% of the total pad width.

The polishing pad 140 further includes planarizing structures in the planarizing medium 142 that control the planarizing properties of the planarizing regions 145–147. In this embodiment, the polishing pad 140 has a first planarizing structure 150 (shown schematically) in the interior region 145 and a second planarizing structure 160 (also shown schematically) in each of the first and second side regions 146 and 147. The first planarizing structure 150 is generally a component of the planarizing medium 142 in the interior region 145, and the second planarizing structure 160 is generally a component of the planarizing medium 142 in each of the side regions 146/147. The first and second planarizing structures 150 and 160 can also be combinations of components in the interior region 145 and the side regions 146/147. For example, the first and second planarizing structures 150 and 160 can be the materials of the planarizing medium 142 in the regions 145–147, abrasive particles attached to the planarizing medium 142, groove patterns in the planarizing medium 142, and/or raised features on the planarizing medium 142. The first planarizing structure 150 has a first planarizing aggressiveness, and the second planarizing structure 160 has a second planarizing aggressiveness less than the first planarizing aggressiveness. As explained below, the first planarizing aggressiveness of the first planarizing structure 150 produces a higher polishing rate in the interior region 145 than the second planarizing aggressiveness of the second planarizing structure 160 in the first and second side regions 146 and 147.

Figure 3:
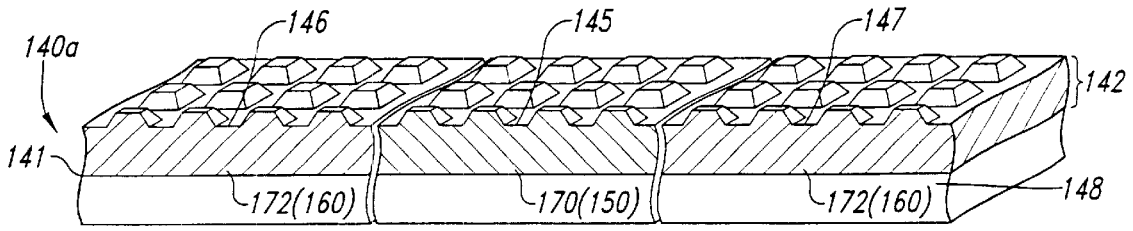
FIG. 3 is a schematic cross-sectional isometric view of a web-format polishing pad in accordance with an embodiment of the invention.

FIG. 3 is a cross-sectional isometric view illustrating a portion of a polishing pad 140*a* in accordance with one embodiment of the invention. In this embodiment, the body 141 further includes a backing film 148 attached to the back side of the planarizing medium 142. The backing film 148 can be a sheet of Mylar® manufactured by E.I. Du Pont de Nemours, Lexan® manufactured by General Electric Company, or other flexible high-tensile strength materials. The first planarizing structure 150 in the interior region 145 is a material 170 having a first hardness, and the second planarizing structure 160 in each of the side regions 146/147 is a material 172 having a second hardness. The first hardness is generally greater than the second hardness. The material 170 of the interior region 145 and the material 172 of the side regions 146/147 can be different materials, or they can be the same materials that are cured or otherwise processed differently to impart a different hardness. In one particular embodiment, the material 170 of the interior region 145 is a resin, acrylic or polyester, and the material 172 of the side regions 146/147 is polyurethane or another material that is more compressible than resin, acrylic or polyester. The harder interior region 145 accordingly removes material from substrate assemblies more aggressively than the first and second side regions 146/147.

The polishing pad 140*a* can be fabricated by providing a segregated mold having three compartments corresponding to the interior region 145 and the side regions 146/147. A relatively hard first material 170 for the first region 145 can be poured in the central section of the mold, and a relatively soft second material 172 for the side regions 146/147 can be poured in the side regions of the mold. After the materials 170/172 have cured, the backing film 148 can be attached to the exposed surface of the materials and the finished planarizing medium 142 can then be removed from the molds.

Figure 4A:
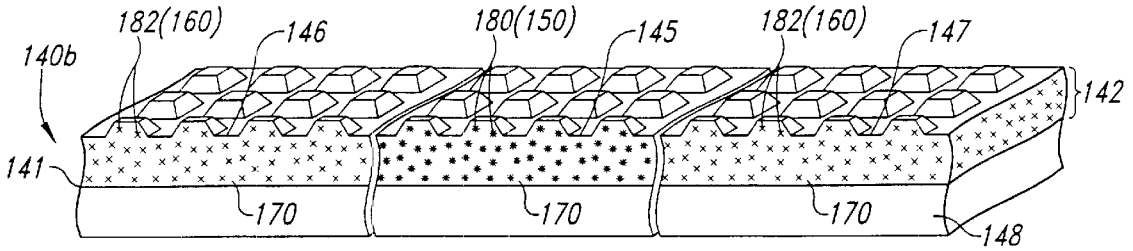
FIGS. 4A and 4B are schematic cross-sectional isometric views of web-format polishing pads in accordance with additional embodiments of the invention.

FIG. 4A is a cross-sectional isometric view of a polishing pad 140*b* in accordance with another embodiment of the invention. In this embodiment, the planarizing medium 142 includes a common suspension medium 170 in the interior region 145 and the side regions 146/147. The planarizing medium 142 can also include a first plurality of abrasive particles 180 dispersed in the suspension medium 170 in the interior region 145 and a second plurality of abrasive particles 182 dispersed in the suspension medium 170 in each of the side regions 146/147. The first planarizing structure 150 is the first abrasive particles 180, and the second abrasive structure 160 is the second abrasive particles 182. The first abrasive particles 180 can be composed of a highly abrasive material, and the second abrasive particles 182 can be composed of a lesser abrasive material. In one embodiment of the polishing pad 140*b* for use with oxide CMP, the first abrasive particles 180 can be composed of cerium oxide ($CeO_2$) and the second abrasive particles 182 can be composed of silicon dioxide ($SiO_2$). In another embodiment for metal CMP, the first abrasive particles 180 can be composed of titanium dioxide ($TiO_2$) and the second abrasive particles 182 can be composed of alumina ($Al_2O_3$). In another embodiment, the first and second abrasive particles 180 and 182 can be composed of the same material, but the first abrasive particles 180 can have a larger average particle size than the second abrasive particles 182. For example, the first abrasive particles 180 can have a particle size from approximately 0.2–1.0 $\mu$m, and the second abrasive particles 182 can have a particle size of approximately 0.05–0.4 $\mu$m. The first abrasive particles 180 are accordingly more abrasive than the second abrasive particles 182 either because of the differences in the types of materials or the sizes of the particles. The interior region 145 is accordingly more abrasive than the side regions 146/147 such that the interior region 145 more aggressively removes material from substrate assemblies than the side regions 146/147.

Figure 4B:
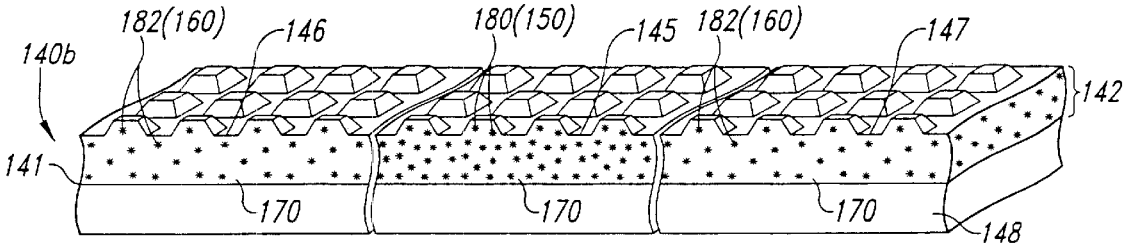

FIG. 4B is a cross-sectional schematic view of another embodiment of the polishing pad 140*b*. In this embodiment, the first and second abrasive particles 180 and 182 can be composed of the same or a different material. The interior planarizing region 145 is more abrasive than the side regions 146/147 because the density of the first abrasive particles 180 is greater than the density of the second abrasive particles 182. In this embodiment, therefore, the first planarizing structure 150 is the density of the first abrasive particles 180 in the interior region 145, and the second abrasive structure 160 is the second density of the second abrasive particles 182 in each of the side regions 146/147.

Figure 5:
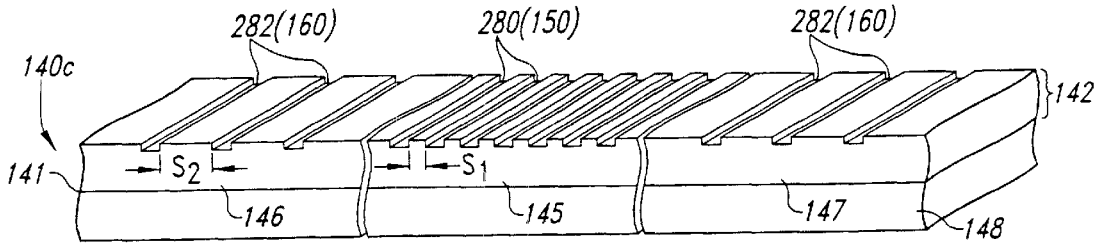
FIG. 5 is a schematic cross-sectional isometric view of a web-format polishing pad in accordance with another embodiment of the invention.

FIG. 5 is a cross-sectional isometric view of a polishing pad 140*c* in accordance with another embodiment of the invention. In this embodiment the planarizing medium 142 has a plurality of first depressions or grooves 280 in the interior region 145 and a plurality of second depressions or grooves 282 in the first and second side regions 146 and 147. The first grooves 280 are spaced apart from one another by a first distance $S_1$ and the second grooves 282 are spaced apart from one another by a second distance $S_2$. The first distance $S_1$ is less than the second $S_2$ such that the density of the first grooves 280 is higher than that of the second grooves 282. The surface area occupied by the first grooves 280 in the interior region 145 is accordingly greater than the surface area occupied by the second grooves 282 in each of the side regions 146/147. If the first and second grooves 280 and 282 have the same depth and an abrasive slurry with abrasive particles is deposited on the pad 140*c*, the plurality of first grooves 280 accordingly holds a larger volume of abrasive particles in the interior region 145 than the plurality of second grooves 282 holds in each of the first and second side regions 146 and 147. Therefore, it is expected that the interior region 145 will more aggressively remove material from substrate assemblies than the first and second side regions 146/147 because the greater volume of slurry in the interior region 145 will provide more abrasive particles and a better distribution of reactive chemicals under the substrate assemblies. In this embodiment, the first planarizing structure 150 is the first plurality of grooves 280 and the second planarizing structure 160 is the plurality of second grooves 282.

Figure 6A:
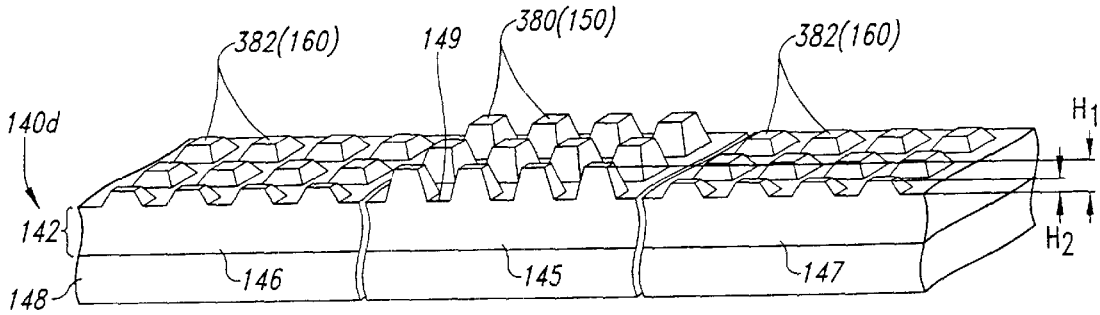
FIGS. 6A and B are schematic cross-sectional isometric views of web-format polishing pads in accordance with other embodiments of the invention.
Figure 6B:
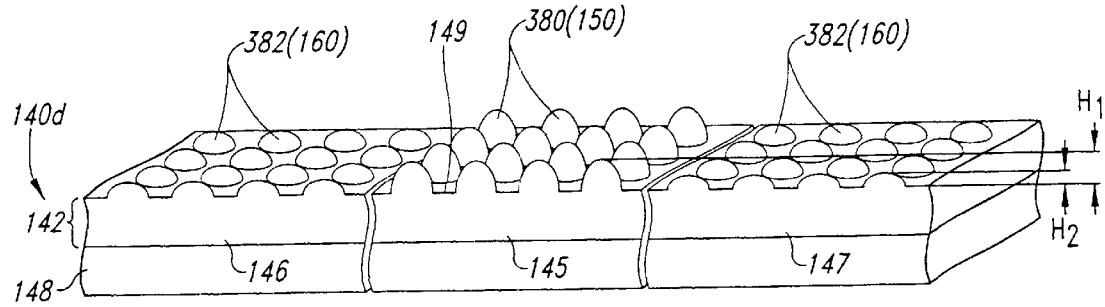

FIGS. 6A and B illustrate several embodiments of a polishing pad 140*d* in accordance with still additional embodiments of the invention. In these embodiments, the planarizing medium 142 has a plurality of first raised features 380 in the interior region 145 and a plurality of second raised features 382 in the first and second side regions 146 and 147. The first raised features 380 define the first planarizing structure 150 and the second raised features 382 define the second planarizing structure 160. The first and second raised features 380 and 382 can be truncated pyramids (FIG. 6A) or hemispherical or elliptical mounds (FIG. 6B), or other suitable shapes. The first raised features 380 have a first average height $H_1$ and the second raised features 382 have a second average height $H_2$ projecting above a base level 149. The average height $H_1$ of the first raised features 380 is greater than the average height $H_2$ of the second raised features 382 such that the interior region 145 removes material from a substrate assembly 12 more aggressively than the first and second side regions 146 and 147. More specifically, when the substrate assembly 12 presses against the interior region 145 and one of the side regions 146 or 147, the first raised features 380 generally exert more force against the substrate assembly 12 than the second raised features 382.

Figure 1:
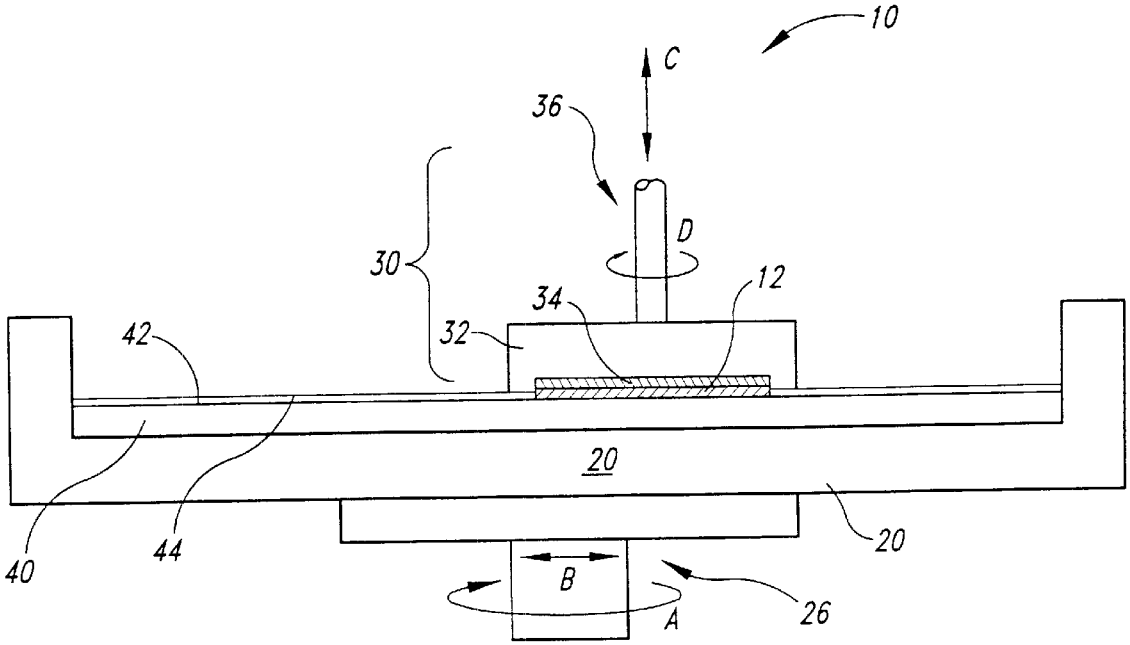
Fig. 1 (Prior Art)
FIG. 1 is a schematic cross-sectional view of a rotary polishing machine in accordance with the prior art.
Figure 7:
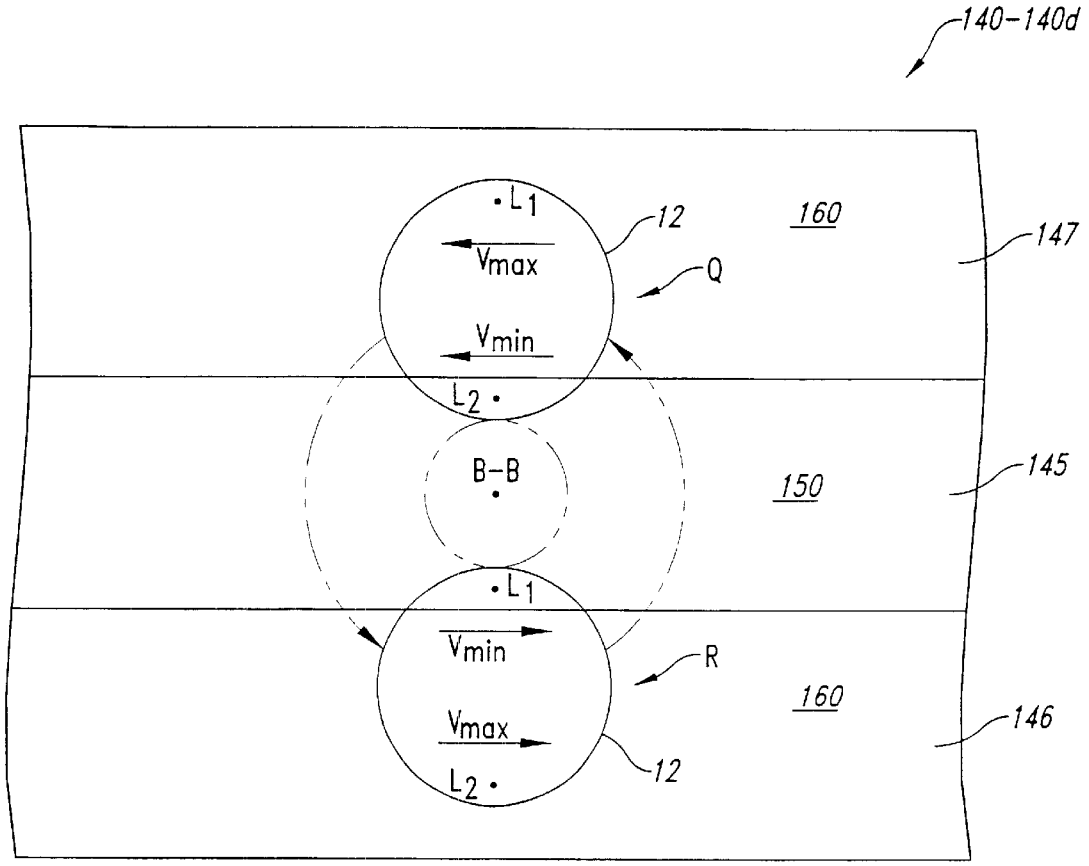
FIG. 7 is a schematic top plan view of the operation of a web-format polishing pad in accordance with the invention.

FIG. 7 is a schematic top plan view illustrating the operation of the web-format planarizing machine 100 shown in FIG. 2 using any one of the polishing pads 140–140*d* shown in FIGS. 3–6C. The polishing pad 140 remains stationary and the carrier assembly 130 (FIG. 1) orbits the substrate assembly 12 about the axis B–B without rotating the substrate assembly 12 about its central axis. When the substrate assembly 12 is in a first position Q, a first perimeter location $L_1$ moves at a maximum linear velocity $V_{MAX}$ and a second perimeter location $L_2$ moves at a minimum linear velocity $V_{MIN}$. The first perimeter location $L_1$ contacts the less aggressive side region 147 at $V_{MAX}$ and the second perimeter location $L_2$ contacts the more aggressive interior region 145 at $V_{MIN}$. As the substrate assembly 12 orbits about the axis B—B from the first position Q to a second position R, the linear velocity of the first perimeter location $L_1$ decreases to $V_{MIN}$ and the linear velocity of the second perimeter location $L_2$ increases to $V_{MAX}$. In the second position R, the first perimeter location $L_1$ contacts the more aggressive interior region 145 and the second perimeter location $L_2$ contacts the less aggressive side region 146. As a result, the locations $L_1$ and $L_2$ each contact the more aggressive interior region 145 at $V_{MIN}$ and one of the less aggressive side regions 146 or 147 at $V_{MAX}$. The polishing pads 140–140*d* are accordingly expected to reduce the center-to-edge difference in thickness of a finished substrate assembly 12 for certain areas along the perimeter of the substrate assembly.

The multiple-zone web-format pads 140–140*d* present an advancement in web-format CMP that is not readily apparent from dual zone circular polishing pads used on rotary polishing machines, such as those described above regarding U.S. application Ser. No. 08/834,524 and U.S. Pat. Nos. 5,435,772 and 5,020,283. Circular dual zone polishing pads generally have concentric, circular zones corresponding to the circular motion of rotary planarizing machines. The rotational motion of rotary pads produces a velocity gradient that increases with increasing radius, which causes rotary polishing pads to inherently planarize more aggressively with increasing radius. The inner zone of dual zone circular pads is accordingly more aggressive than the outer zone to compensate for the planarizing characteristics of rotary polishing pads caused by the rotational motion. In contrast to rotary polishing pads, web-format pads are generally stationary during the planarizing cycle. Web-format pads without the different zones, therefore, have uniform planarizing characteristics. Thus, the use of dual zones in web-format pads is not readily apparent based on the teachings of rotary polishing pads.

Figure 8:
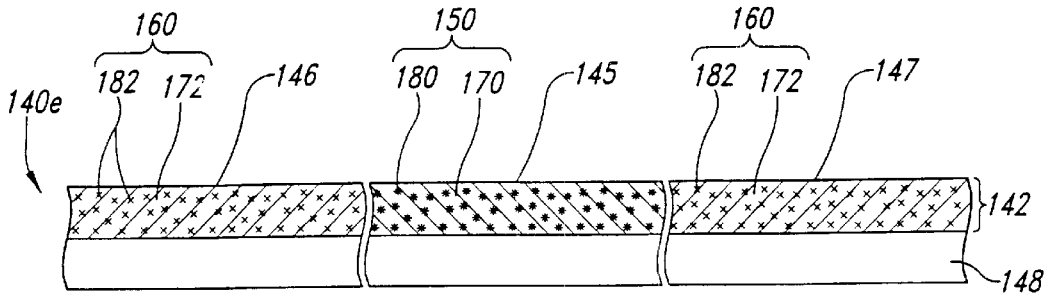
FIG. 8 is a schematic cross-sectional view of a web-format polishing pad in accordance with an embodiment of the invention.
Figure 9:
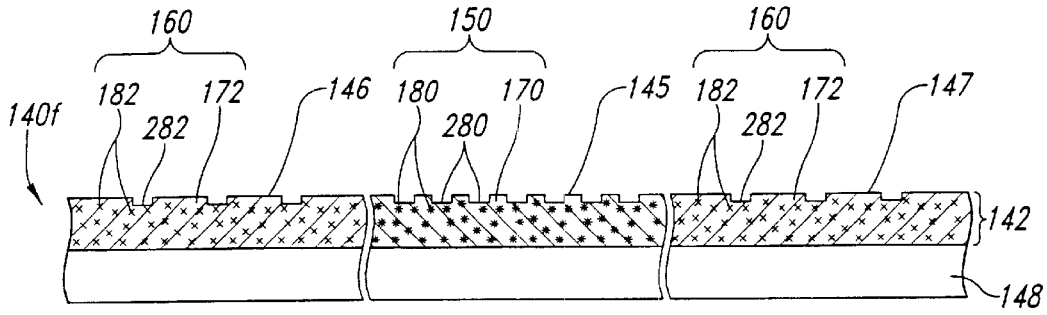
FIG. 9 is a schematic cross-sectional view of another web-format polishing pad in accordance with another embodiment of the invention.
Figure 10:
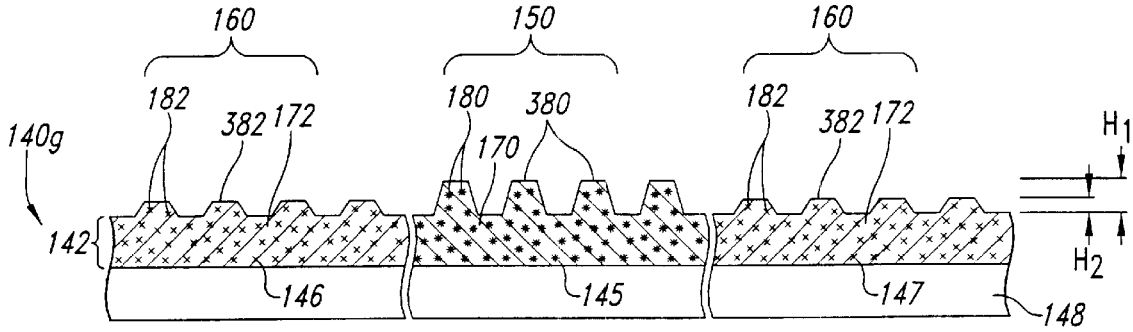
FIG. 10 is a schematic cross-sectional view of still another web-format polishing pad in accordance with still another embodiment of the invention.

FIGS. 8–10 are cross-sectional views of polishing pads 140*e*–140*g* in accordance with additional embodiments of the invention in which the first and second planarizing structures 150 and 160 are defined by a combination of two or more separate planarizing components in the interior region 145 and the side regions 146/147. FIG. 8 illustrates a polishing pad 140*e* having an interior region 145 including a plurality of first abrasive particles 180 attached to a first suspension medium 170, and the side regions 146/147 include a plurality of second abrasive particles 182 attached to a second suspension medium 172. The first abrasive particles 180 can be more abrasive and/or larger than the second abrasive particles 182. Additionally, the first suspension medium 170 can be less compressible or harder than the second suspension medium 172. The abrasive particles 180/182 and the suspension mediums 170/172 can be similar to those described above with respect to FIGS. 3–4B. The interior region 145, therefore, more aggressively planarizes substrate assemblies than the side regions 146, 147.

FIG. 9, more particularly, illustrates another polishing pad 140*f* in which the first planarizing structure 150 includes the first suspension medium 170, the first abrasive particles 180 and a plurality of first trenches 280 in the interior region 145. The polishing pad 140*f* also has a second abrasive structure 160 including the second suspension medium 172, the second abrasive particles 182 and a plurality of second trenches 282 in each of the side regions 146/147. FIG. 10 illustrates a polishing pad 140*g* in which the first planarizing structure 150 includes the first suspension medium 170, the first abrasive particles 180 and the first raised features 380 having an average height $H_1$, and the second planarizing structure 160 includes the second suspension medium 172, the second abrasive particles 182 and the second raised features 382 having a height $H_2$.

From the foregoing it will be appreciated that, although specific embodiments of the invention have been described herein for purposes of illustration, various modifications may be made without deviating from the spirit and scope of the invention. For example, the combinations of planarizing components are not limited to those described and shown with respect to FIGS. 2–10, and can include any combination of different suspension mediums, abrasive particles, trenches and heights/shape of raised features. Accordingly, the invention is not limited except as by the appended claims.

What is claimed is:

1. A web-format planarizing machine, comprising:

a stationary planarizing table having a planarizing zone;

at least one roller proximate to the table;

a carrier assembly having a head for holding a microelectronic substrate assembly, the head being moveable over the table; and a polishing pad having an active section on the planarizing zone of the table and an inactive section wrapped around the roller, the polishing pad including a body having a planarizing medium, an elongated first side edge, an elongated second side edge opposite the first side edge, and a length sufficient to extend across the planarizing zone and wrap around the roller, the planarizing medium having an elongated interior region extending lengthwise along the body, an elongated first exterior side region extending lengthwise along the first side edge and an elongated second exterior side region extending lengthwise along the second side edge, the polishing pad further having a first planarizing structure in the interior region of the planarizing medium and a second planarizing structure in each of the first and second side regions of the planarizing medium, the first planarizing structure having a first planarizing aggressiveness and the second planarizing structure having a second planarizing aggressiveness less than the first planarizing aggressiveness.

2. The planarizing machine of claim 1 wherein the first planarizing structure comprises a material having a first hardness and the second planarizing structure comprises a material having a second hardness, the first hardness being greater than the second hardness.

3. The planarizing machine of claim 2 wherein the interior region of the planarizing medium comprises an elongated section of resin, and the first and second side regions of the planarizing medium each comprise a separate elongated section of polyurethane, the first and second side regions having the same hardness.

4. The planarizing machine of claim 2 wherein the interior region of the planarizing medium comprises an elongated section of acrylic and the first and second side regions of the planarizing medium each comprise a separate elongated section of polyurethane, the first and second side regions having the same hardness.

5. The planarizing machine of claim 2 wherein the first interior region of the planarizing medium comprises an elongated section of a polyester and the first and second side regions of the planarizing medium each comprise a separate elongated section of polyurethane, the first and second side regions having the same hardness.

6. The planarizing machine of claim 1 wherein the first planarizing structure comprises a plurality of first trenches in the interior region of the planarizing medium and the second planarizing structure comprises a plurality of second trenches in each of the first and second side regions of the planarizing medium, the plurality of first trenches having a first volume and the plurality of second trenches having a second volume less than the first volume.

7. The planarizing machine of claim 6 wherein the first trenches comprise a plurality of first grooves spaced apart from one another by a first distance and the second trenches comprise a plurality of second grooves spaced apart from one another by a second distance, the first distance being less than the second distance.

8. The planarizing machine of claim 6 wherein the first trenches comprise a plurality of first grooves and the second trenches comprise a plurality of second grooves, the plurality of first grooves occupying more surface area per square meter of the planarizing medium than the plurality of second grooves.

9. The planarizing machine of claim 1 wherein the first planarizing structure comprises a plurality of first depressions in the planarizing medium and the second planarizing structure comprises a plurality of second depressions in the planarizing medium, the plurality of first depressions having a first volume and the plurality of second depressions having a second volume less than the first volume.

10. The planarizing machine of claim 1 wherein the first planarizing structure comprises a plurality of first abrasive particles fixedly attached to the interior region of the body and the second planarizing structure comprises a plurality of second abrasive particles fixedly attached to the first and second side regions of the body, the interior region having a higher abrasiveness than the first and second side regions.

11. The planarizing machine of claim 1 wherein the first planarizing structure comprises a plurality of first abrasive particles fixedly attached to the interior region of the body and the second planarizing structure comprises a plurality of second abrasive particles fixedly attached to the first and second side regions of the body, the first abrasive particles being composed of a first material having a first abrasiveness and the second abrasive particles being composed of a second material having a second abrasiveness, the first abrasiveness being greater than the second abrasiveness.

12. The planarizing machine of claim 11 wherein the first abrasive particles comprise titanium oxide particles and the second abrasive particles comprise aluminum oxide particles.

13. The planarizing machine of claim 11 wherein the first abrasive particles comprise cerium oxide particles and the second abrasive particles comprise silicon oxide particles.

14. The planarizing machine of claim 1 wherein the first planarizing structure comprises a plurality of first abrasive particles fixedly attached to the interior region of the body and the second planarizing structure comprises a plurality of second abrasive particles fixedly attached to the first and second side regions of the body, the first abrasive particles having a first density in the first interior region and the second abrasive particles having a second density in each of the first and second side regions, the first density being greater than the second density.

15. The planarizing machine of claim 1 wherein the first planarizing structure comprises a plurality of first abrasive particles fixedly attached to the interior region of the body and the second planarizing structure comprises a plurality of second abrasive particles fixedly attached to the first and second side regions of the body, the first abrasive particles having a first height above the planarizing medium and the second abrasive particles having a second height above the planarizing medium, the first height being greater than the second height.

16. At The planarizing machine of claim 1 wherein the first planarizing structure comprises a plurality of first abrasive particles fixedly attached to the interior region of the body and the second planarizing structure comprises a plurality of second abrasive particles fixedly attached to the first and second side regions of the body, the first abrasive particles having a first size and the second abrasive particles having a second size, the first size being greater than the second size.

* * * * *

UNITED STATES PATENT AND TRADEMARK OFFICE

CERTIFICATE OF CORRECTION

PATENT NO. : 6,354,919 B2
DATED : March 12, 2002
INVENTOR(S) : Dinesh Chopra

It is certified that error appears in the above-identified patent and that said Letters Patent is hereby corrected as shown below:

Title page,
Item [56], References Cited, OTHER PUBLICATIONS,
Reads "http:///" should read -- http:// --
Reads "/1996 projects/" should read -- /1996_projects/ --
Reads "lasct" should read -- last --
Reads "3 pages" should read -- 1 page --
Reads "electroytes" should read -- electrolytes --
Reads "prolcedure" should read -- procedure --
Reads "Zetasier" should read -- Zetasizer --

Column 12,
Line 11, "At The" should read -- The --

Signed and Sealed this

Twenty-fourth Day of September, 2002

*Attest:*

*Attesting Officer*

JAMES E. ROGAN
*Director of the United States Patent and Trademark Office*